United States Patent [19]

Hyman et al.

[11] 4,049,038

[45] Sept. 20, 1977

[54] LOUVERED COVERING SYSTEM

[75] Inventors: David L. Hyman; Robert J. Cayton; Kurt E. Rosenquist, all of Pacific Palisades, Calif.

[73] Assignee: Louverdrape, Inc., Santa Monica, Calif.

[21] Appl. No.: 679,764

[22] Filed: Apr. 23, 1976

[51] Int. Cl.[2] ..... E06B 9/26

[52] U.S. Cl. ..... 160/166 A; 52/473; 160/178 R; 160/236

[58] Field of Search ..... 160/166 A, 166 R, 178 R, 160/236, 166; 52/473, 312, 716

[56] References Cited

U.S. PATENT DOCUMENTS

| | | | |
|---|---|---|---|
| 2,074,482 | 3/1937 | Martens | 160/236 |
| 2,142,629 | 1/1939 | Clark, Jr. | 160/236 X |
| 2,326,454 | 8/1943 | Gentile | 160/236 |
| 2,590,204 | 3/1952 | Phillips | 160/236 |
| 2,914,122 | 11/1959 | Pinto | 160/166 R |
| 2,994,370 | 8/1961 | Pinto | 160/236 X |
| 3,141,954 | 7/1964 | Simon | 160/166 A |
| 3,550,340 | 12/1970 | Klein | 52/312 |

FOREIGN PATENT DOCUMENTS

| | | | |
|---|---|---|---|
| 1,683,228 | 2/1971 | Germany | 160/236 |
| 263,884 | 12/1949 | Switzerland | 160/178 R |

*Primary Examiner*—Alfred C. Perham
*Attorney, Agent, or Firm*—Lyon & Lyon

[57] ABSTRACT

A system for functional and decorative covering of windows and the like providing a plurality of louvers in association with a louvered support system. The louvers include means for attaching wallpaper, reflective materials and other covering materials to each louver in a convenient manner.

The covering materials are held on each louver by flanges running along each elongate edge thereof. Further, the covering materials are held from sliding longitudinally along each louver at a single attachment point. A backing material of rigid construction may be employed with thin wallpaper and the like.

5 Claims, 7 Drawing Figures

LOUVERED COVERING SYSTEM

BACKGROUND OF THE INVENTION

The present invention is directed to a louvered covering system. More specifically, the present invention is directed to a louvered covering system capable of accomodating decorative and functional covering materials associated with each louver.

Louvered window coverings and the like have been used extensively for decorative and functional covering of windows, doors and the like. It has been known to paint or otherwise cover louvers in such systems to match the building or room decor. It has also been known to provie reflective louvers as a means for reducing the heating effect of direct sunlight into a room. Naturally, privacy is also provided by such systems. When the decorative or functional requirements of the louvered system has changed, it has been necessary to either replace the entire louvered covering system or simply the louvers themselves. Furthermore, when conventional louvers have been coated with a decorative or functional covering material, humidity and temperature changes can cause sever distortion of the composite louvers detracting greatly from their appearance.

SUMMARY OF THE INVENTION

The present invention is directed to a louvered covering system which allows great flexibility in the decorative and functional effect of the system and overcomes the problem of louver distortion caused by variations in ambient temperature and humidity conditions. To accomplish this flexibility, louvers are provided with flanges running along each elongate edge thereof. The flanges extend inwardly to form a very wide, low channel capable of slidably receiving elongate cover members having a decorative or functional surface. The inward disposition of the flanges prevents facile movement of a positioned cover member away from the louver except by drawing the cover member longitudinally along the louver. This interlocking of the louver and a cover member positioned therein allows the composite louver assembly to appear as if the cover member were rigidly fixed along its entire length to the louver.

To hold each cover member from sliding longitudinally along the louver in the interlocking channel, the louver member is fixed at one point by glue, a rivit or some other fastening means. By fixing the cover member at only one point, expansion and shrinkage of the cover member relative to the louver may occur with the cover member sliding in the interlocking channel. Only the one fixed point remains stationary. Thus, the composite louver structure will not warp under unfavorable ambient conditions. The cover member itself may include a decorative, flimsy sheet with a heavier backing. In such an assembly, the flimsy sheet and heavier backing are together attached to the louver through interlocking in the channel and being fixed at one point against relative longitudinal movement.

The wide, low, interlocking channel may be used to hold, inter alia, wallpaper, painted strips, reflective strips or non-reflective strips. These panels so covered may be employed to face toward the room or toward the outside. Furthermore, a wide, low, interlocking channel may be provided on both sides of such a panel to provide, for instance, a decoractive covering on one side and a sun reflective covering on the other side.

Obviously, the present invention is extremely versatile and many other combinations may be employed with the panels.

Accordingly, it is an object of the present invention to provide an improved louvered covering system.

It is a further object of the present invention to provide a louvered covering system which eliminates warping of the covered louvers due to temperature and humidity changes.

Is is another object of the present invention to provide a louvered covering system having the versatile capability for changing appearance and function.

Other objects and advantages will appear hereinafter.

DETAILED DESCRIPTION OF THE PREFERRED EMBODIMENT

Figure 1:
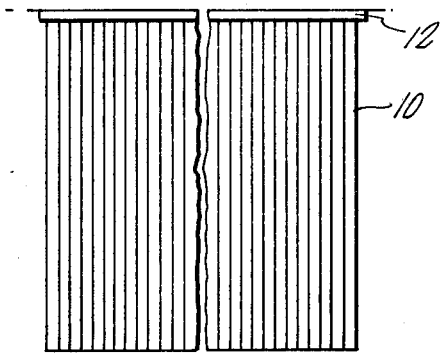
FIG. 1 is a front elevation of a louvered covering system illustrating the use of vertical louvers.
Figure 4:
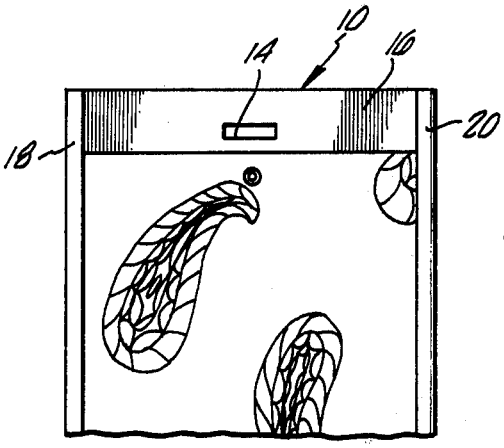
FIG. 4 is another louver of the present invention illustrating an alternate attachment means.
Figure 5:
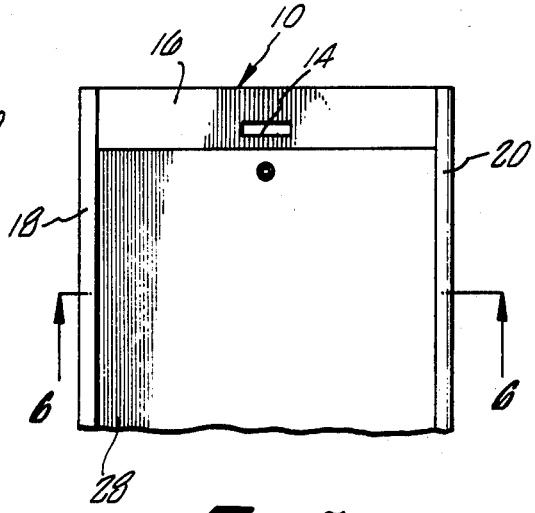
FIG. 5 is a detailed plan view of another louver having a cover member of reflective metallic material.

Turning in detail to the drawings, FIG. 1 illustrates a louvered covering system including vertical louvers 10 associated with a louver support system 12 of a conventional design. Any one of the louvers together with a variety of covering systems such as those disclosed in FIGS. 2 through 7 may be employed with such a conventional louver support system 12. Commonly, conventional louver support systems 12 include a wide flat hooking member which cooperates with a slot to both hang the vertical louver 10 and effect some contact over its orientation about a vertical axis. Such an attachment means may include a slot 14 such as seen in FIGS. 2, 4 and 5.

Figure 2:
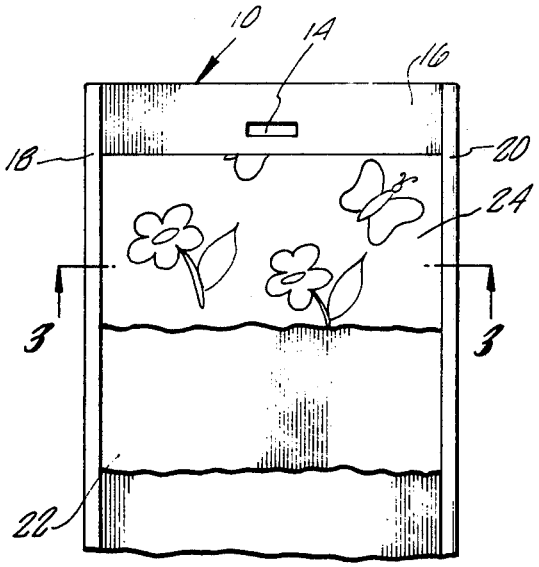
FIG. 2 is a detailed plan view of a louver of the present invention partially broken away for clarity.
Figure 3:
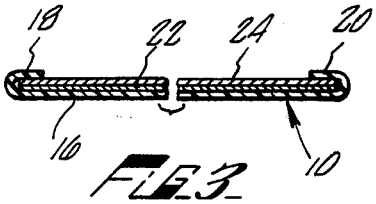
FIG. 3 is a cross-sectional end view taken along line 3—3 of FIG. 2.

Turning then to the details of each louver, FIGS. 2 and 3 illustrate a first embodiment which includes an elongate panel 16 which is most conveniently of plastic material such as polyvinyl chloride. Along each elongate edge of the elongate panel 16 is a flange 18 and 20. The flanges 18 and 20 each extend inwardly on the same side of the panel to form a wide, low, interlocking channel. This channel is capable of receiving and holding covering materials to provide a decorative or functional aspect to the panel. The covering materials positioned therein will interlock with the channel thereby allowing only longitudinal movement of the covering material in the channel.

Located on the elongate panel 16 between the flanges 18 and 20 and in interlocking engagement therewith in FIGS. 2 and 3 is a composite cover member. A stiff backing sheet 22 is provided as part of the cover member. The stiff backing sheet 22 may be of heavy grade paper or cardboard capable of remaining positioned on the elongate panel 16 without assuming a wrinkled or bent position. Furthermore, the stiffer the backing sheet 22, the easier it becomes to position the sheet 22 on the elongate panel 16 inside of the flanges 18 and 20. The stiff backing sheet 22 may be held in place on the vertical elongate panel 16 by a single spot of glue between the sheet 22 and the panel 16 near the upper end of the louver. Such a single spot of glue may be easily broken to release the stiff backing sheet 22 for replacement by another such sheet.

By employing a single attachment point for the cover member on the louver, the cover member is allowed relative expansion and contraction due to temperature and humidity without causing distortion of the louver. If attachment of the cover member was made all along the louver, unequal expansion rates would cause the cover sheet to distort the louver. The interlocking channels of the louvers allow relative longitudinal movement of the cover members to relieve any stresses which might otherwise build up.

In the embodiment of FIGS. 2 and 3, a sheet of decorative wallpaper 24 is provided as part of the elongate cover member extending between the flanges 18 and 20 and preferably running substantially the whole length of the elongate panel 16. Decorative wallpaper is commonly quite flexible and would not, hanging by itself, provide a flat, smooth covering for the louver 10. However, the decorative wallpaper 24 may be glued or otherwise conventionally attached to the stiff backing sheet 22 in at least a plurality of positions along the stiff backing sheet 22 so that the composite structural nature of the louver cover member is like that of the stiff backing sheet 22. Naturally, any wallpaper or decorative paper material may be employed. Thus, by simply changing the stiff backing sheet 22 and the decorative wallpaper 24 on each louver 10 of the louvered covering system, the entire louvered covering system may be changed in apperance to reflect a different decorative appearance.

Figure 6:
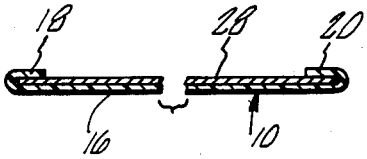
FIG. 6 is a cross-sectional end view of the louver of FIG. 5 taken along line 6—6 of FIG. 5.

FIGS. 4 through 6 illustrate another method of attachment of the panel covering. A rivet 26 is employed to hold the panel covering to the panel 16. This is preferably employed as a means of attachment for panel covering materials of a rather sturdy construction. FIG. 5 specifically illustrates the incorporation of a metal sheet 28 having a highly reflective surface. The highly reflective surface may act to reflect sunlight to help control the temperature of a room. The sheet 28 may also be of a plastic or foil material.

Figure 7:
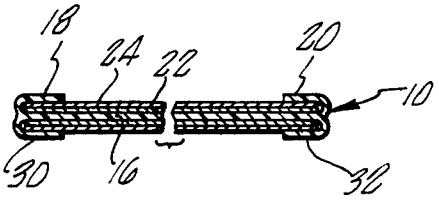
FIG. 7 is a cross-sectional end view illustrating a louver having a wide, low, interlocking channel on each side thereof.

FIG. 7 illustrates yet another embodiment which incorporates a second set of flanges 30 and 32 to accommodate a second panel covering on the back side of the elongate panel 16.

Thus, a means is disclosed which provides for the easy assembly and alteration of the decorative or functional nature of a louvered covering system and prevents warping of the louvers caused by temperature and humidity effects on the louver covering. While embodiments and applications of this invention have been shown and described, it would be apparent to those skilled in the art that many more modifications are possible without departing from the inventive concepts herein descrbied. The invention, therefore, is not to be restricted except by the spirit of the appended claims.

What is claimed is:

1. A louvered covering system comprising a vertical louver support system;

elongate louvers, each said elongate louver including means adjacent one end thereof for attachment to said vertical louver support system such that said elongate louver depends vertically therefrom, an elongate panel forming the body of said elongate louver, a flange along each elongate edge of said panel, said flanges extending inwardly toward one another on a first side of said panel, an elongate sheet slidably arranged on said elongate panel between said flanges, and mounting means for fixing said sheet at one spot only to said panel near said attachment means.

2. The louvered covering system of claim 1 wherein said elongate sheet includes wallpaper.

3. The louvered covering system of claim 1 wherein said elongate sheet includes a stiff backing sheet.

4. The louvered covering system of claim 1 wherein said elongate sheet has a surface of high reflectivity.

5. The louvered covering system of claim 1 wherein said elongate panels each further include a second flange along each elongate edge thereof, said second flanges extending inwardly toward one another on a second side of said panel, a second elongate sheet slidably arranged on said elongate panel between said flanges, and second mounting means for fixing said second sheet at one spot only to said panel near said attachment means.

* * * * *

REEXAMINATION CERTIFICATE (1122nd)

United States Patent [19]

Hyman et al.

[11] B1 4,049,038

[45] Certificate Issued Sep. 12, 1989

[54] LOUVERED COVERING SYSTEM

[75] Inventors: David L. Hyman; Robert J. Cayton; Kurt E. Rosenquist, all of Pacific Palisades, Calif.

[73] Assignee: Loverdrape, Inc., Santa Monica, Calif.

Reexamination Request:
No. 90/001,547, Jul. 1, 1988

Reexamination Certificate for:

| | |
|---|---|
| Patent No.: | 4,049,038 |
| Issued: | Sep. 20, 1977 |
| Appl. No.: | 679,764 |
| Filed: | Apr. 23, 1976 |

[51] Int. Cl.[4] ..... E06B 9/26

[52] U.S. Cl. ..... 160/166.1; 160/178.1; 160/236; 160/900; 52/473

[58] Field of Search ..... 160/166.1, 900, 178.1, 160/236; 52/473, 312, 716

[56] References Cited

U.S. PATENT DOCUMENTS

| | | | |
|---|---|---|---|
| 1,639,474 | 8/1927 | Whitmore | 160/236 |
| 3,277,952 | 10/1966 | Tsuhako | 160/199 |
| 3,419,063 | 12/1968 | Mock et al. | 160/199 |

*Primary Examiner*—Ramon S. Britts
*Assistant Examiner*—David M. Purol

[57] ABSTRACT

A system for functional and decorative covering of windows and the like providing a plurality of louvers in association with a louvered support system. The louvers include means for attaching wallpaper, reflective materials and other covering materials to each louver in a convenient manner.

The covering materials are held on each louver by flanges running along each elongate edge thereof. Further, the covering materials are held from sliding longitudinally along each louver at a single attachment point. A backing material of rigid construction may be employed with thin wallpaper and the like.

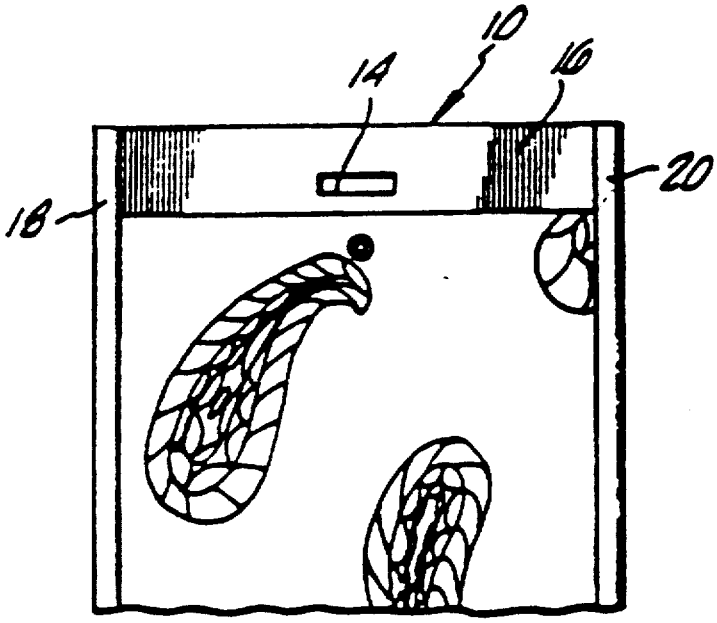

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–5, dependent on an amended claim, are determined to be patentable.

New claim 6 is added and determined to be patentable.

1. A louvered covering system comprising:
a vertical louver support system;
*a plurality of* elongate louvers, each said elongate louver including means adjacent [one] *an upper* end thereof for attachment to said vertical louver support system such that said elongate louver depends vertically therefrom, an elongate panel forming the body of said elongate louver, a flange along each elongate edge of said panel, said flanges extending inwardly toward one another on a first side of said panel *and forming a channel*, an elongate sheet [slidably arranged on said elongate panel between said flanges] *having a pair of outer elongate edges for slidable engagement in said channel to accommodate longitudinal expansion and shrinkage of said sheet*, and mounting means for fixing said sheet at one spot only to said panel near said attachment means *and for securing said sheet in said covering system, yet allowing for slidable longitudinal movement of said sheet in said channel to prevent louver distortion caused by variations in ambient environmental conditions.*

*6. A louvered covering system comprising:*
*a support system for vertical louvers, said system having attachment means;*
*a plurality of elongate louvers, each said louver having means adjacent an upper end thereof for connection to said attachment means such that said elongate louver depends vertically and independently from said support system, an elongate panel forming the body of said elongate louver, said panel having an inwardly directed flange along each elongate edge of said panel, said flanges and said panel defining a channel;*
*an elongate sheet having a pair of elongate edges and configured to be slidably engaged in said channels to accommodate longitudinal expansion and lateral or longitudinal contraction of said sheet relative to said panel; and*
*mounting means for suspending said sheet from one spot only near said attachment means to secure said sheet to said system and for permitting sufficient longitudinal sliding as well as lateral expanding movement of said sheet in said channel to prevent warping of said conbined louver and sheet structure under unfavorable ambient conditions.*

* * * * *